US005176614A

United States Patent [19]

Krasuski

[11] Patent Number: 5,176,614

[45] Date of Patent: Jan. 5, 1993

[54] THREE-PORTION FOLDING MACHINE HAVING POCKETS

[75] Inventor: Marek Krasuski, Fontenay Aux Roses, France

[73] Assignee: Alcatel Satmam, Bagneux, France

[21] Appl. No.: 782,482

[22] Filed: Oct. 25, 1991

[30] Foreign Application Priority Data

Oct. 31, 1990 [FR] France ..... 90 13580

[51] Int. Cl.[5] ..... B65H 45/14

[52] U.S. Cl. ..... 493/421; 493/479

[58] Field of Search ..... 493/420, 421, 479

[56] References Cited

U.S. PATENT DOCUMENTS

| | | | |
|---|---|---|---|
| 4,573,672 | 3/1986 | Lehmann et al. | 493/420 |
| 4,619,101 | 11/1986 | Havey, Jr. et al. | 53/117 |
| 5,000,432 | 3/1991 | Krasuski et al. | 493/421 |

FOREIGN PATENT DOCUMENTS

| | | | |
|---|---|---|---|
| 157349 | 10/1985 | European Pat. Off. | 493/421 |
| 0352694 | 6/1990 | France . | |
| 2670 | 1/1986 | Japan | 493/421 |

*Primary Examiner*—William E. Terrell

*Attorney, Agent, or Firm*—Sughrue, Mion, Zinn, Macpeak & Seas

[57] ABSTRACT

A two-pocket folding machine has a case formed by a top case portion hinged to a bottom case portion. The case has a top pocket and a bottom pocket, with each pocket including a first plate and a second plate. The top case portion includes the first plate of the top pocket, with the top pocket first plate being fixed to the top case portion. The bottom case portion includes the first plate of the bottom pocket, which is fixed to the bottom case portion. A moving assembly includes preferably a pair of movable panels, with the second plate of the bottom pocket and the second plate of the top pocket being fixed to the movable panels and moving with the moving assembly. The moving assembly is displaced along a predetermined trajectory with respect to the top and bottom case portions during opening and closing of the top and bottom case portions such that the second plates are parallel to and close to the corresponding first plates when the case portions are closed. The first and second plates move away from each other in both the top and bottom case portions when the case portions are open to provide ready access to the insides of the pockets.

6 Claims, 2 Drawing Sheets

THREE-PORTION FOLDING MACHINE HAVING POCKETS

The invention relates to a folding machine having two pockets and three portions, and being designed to fold documents automatically so that they can be put into envelopes.

BACKGROUND OF THE INVENTION

A folding machine having two pockets enables a document to be folded in three by forming two successive folds. In order to form a fold, each pocket co-operates with three rollers. Each pocket has the shape of a flat housing including an abutment at one end and orifice at the opposite end. Two first rollers enable the document to be inserted into and advanced through the orifice of the pocket. The document comes up against the abutment, while the advance which continues to be communicated to the document causes a buckle to be formed therein, which buckle projects from the orifice of the pocket. This buckle is engaged and nipped between two rollers which thereby make the desired fold and then eject the document out of the pocket, via the same orifice.

U.S. Pat. No. 4,619,101 describes a first folding machine including two pockets disposed in a truncated V layout and associated with a set of four rollers, one of which is used for both pockets. That folding machine comprises two hinged portions: a "top" portion and a "bottom" portion. A "top" pocket is situated in the top portion and a "bottom" pocket is situated in the bottom portion.

Jamming may occur, in particular when a plurality of different-sized documents are to be folded simultaneously. The user must have access to each pocket so as to clear any jamming. In order to facilitate access, each pocket includes a fixed plate and a moving plate. These two plates are coupled together by a hinge axis situated at one end of the pocket. When the two portions of the machine are closed, the moving plate and the fixed plate are parallel in each pocket. That first folding machine includes a set of four rollers which cannot be disassembled when the folding machine is open. The set of rollers remains close to the orifice of the bottom pocket.

The hinge axis of the bottom pocket is situated near to the orifice of the pocket, close to the set of rollers. The bottom pocket thus opens at its other end, close to the hinge of the machine. User access is therefore from the least convenient direction. The user must lift the moving plate with one hand and pass the other hand around the set of four rollers and the moving plate in order to clear a document jammed in the pocket. In that first known folding machine, each pocket has an abutment whose position may not be adjusted.

European Patent Application No. 0,352,694 describes a second folding machine also including two pockets disposed in a truncated V layout and associated with a set of four rollers, one of which is used for both pockets. That machine is also composed of two hinged portions, but the four rollers may be disassembled when the two portions are open. Each of the pockets has a fixed plate and a moving plate coupled together by a hinge axis.

In that second folding machine, the hinge axis of the bottom pocket is situated at its end that is distant from its end having the orifice. The bottom pocket therefore opens close to the rollers. Access for the user is therefore from the most convenient direction. Unfortunately, access from this direction is hindered by the presence of the rollers. Two of the four rollers are fixed to the bottom portion. The other two rollers are fixed to the top portion. They retract when the folding machine is open, thereby reducing the hindrance caused by the rollers, but not removing it altogether.

When the two portions are open, a cable fixed to the bottom portion pulls the moving plate of the top pocket so as to open it, and a cable fixed to the top portion pulls the moving plate of the bottom pocket so as to open it. Each pocket is thus opened in a wedge shape to an angle of about 30°, the extent of pivoting of the moving plate being limited by surrounding obstacles. A user may therefore clear a jam by hand, by removing a document stuck in either of the pockets. The user may also adjust the abutments defining the positions of the folds to be made in the document.

Those two known folding machines both suffer from the drawback of having quite difficult access to the bottom of each pocket, close to its hinge axis, because the distance between the fixed plate and the moving plate decreases going towards the hinge axis. In the second known folding machine, access to the bottom pocket is hindered by the presence of one of the rollers, and it is difficult to remedy this by increasing the pivot angle of the moving plate of the bottom pocket, because the travel of the moving plate is limited by the space occupied by adjacent parts.

An object of the invention is to provide a two-pocket folding machine offering better access into both pockets, and in particular the bottom pocket.

SUMMARY OF THE INVENTION

The invention provides a two-pocket folding machine, having a "top" pocket and a "bottom" pocket, each pocket having a "fixed" plate and a "moving" plate, wherein said folding machine comprises:

a "top" casing portion which includes the fixed plate of the top pocket;

a fixed "bottom" casing portion which includes the fixed plate of the bottom pocket, and has the top portion hinged thereto by a hinge;

a moving portion or assembly comprising a movable panel, the moving plate of the bottom pocket, and the moving plate of the top pocket, the two moving plates being in fixed relationship relative to each other on said movable panel; and means for displacing the moving assembly along a predetermined trajectory, during opening and closing the top case portion relative to the bottom portion, each of the moving plates being parallel to and close to the corresponding fixed plate when said case portions are closed, and being moved away from each other when said case portions are open, so as to provide access to the insides of the pockets.

A folding machine implemented in this way provides better access into each pocket because its moving plate is not linked to the fixed plate by a hinge axis, but is independent since it is supported by a moving assembly which may be displaced along a predetermined trajectory. The trajectory may be chosen freely as a function of the ease of access that is desired. In particular, the trajectory may be chosen so that any point on the moving plate is brought to a distance greater than a fixed minimum value, relative to an equivalent point on the fixed plate. In this way the gap between the two plates is not necessarily narrow at one end of the pocket, as is the case in a pocket having a hinge axis.

In particular, the moving plate of the bottom pocket may be put in a position almost parallel to the fixed plate so as to provide access of substantially constant width all the way to the bottom of the bottom pocket, which is the more difficult pocket to access because of the presence of a roller at its entrance.

BRIEF DESCRIPTION OF THE DRAWINGS

An embodiment of the invention is described by way of example with reference to the accompanying drawings, in which.

DETAILED DESCRIPTION

Figure 1:
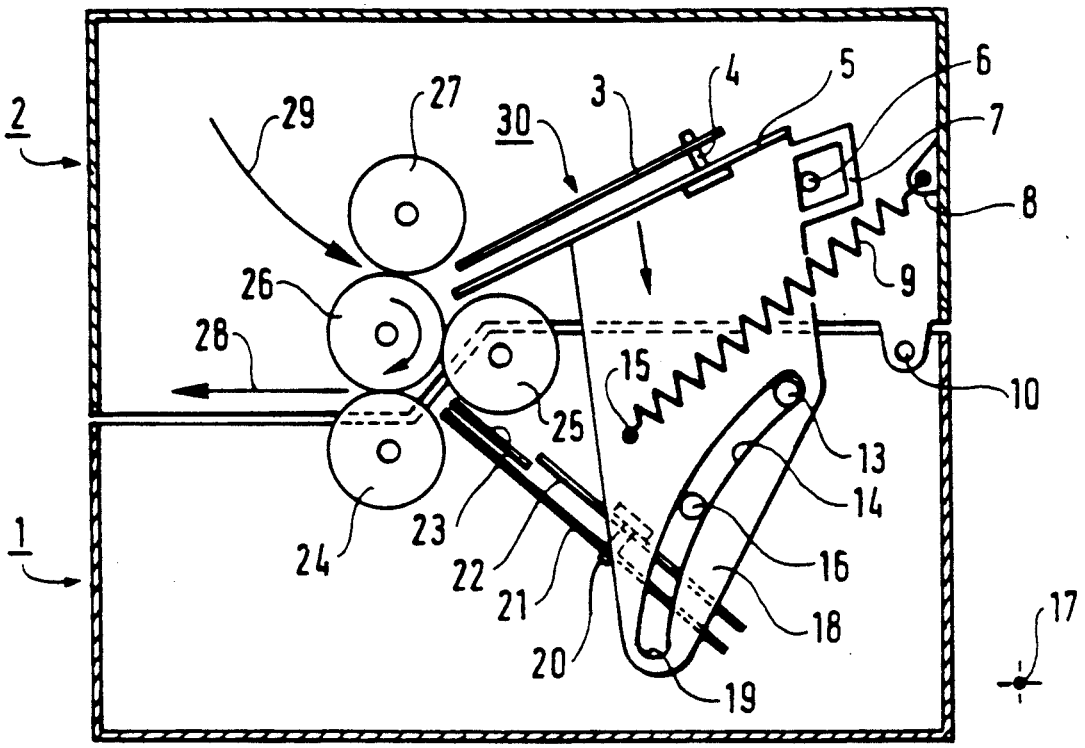
FIG. 1 is a diagram showing an embodiment of a folding machine of the invention, with its three portions being closed so as to enable the folding machine to operate.

In FIG. 1, the frame of the embodiment is represented diagrammatically as a case enclosing the mechanism of the folding machine. This embodiment includes a bottom case portion 1 which is hinged to a top case portion 2 by means of a hinge 10.

The mechanism comprises:

a set of four rollers 24 to 27 mounted within the case, with rollers 26 turning at a constant speed and driving the other rollers;

a "top" pocket situated in the top case portion 2 and comprising: a fixed plate 3, a moving plate 5, and an adjustable abutment 4; and a "bottom" pocket situated in the bottom case portion 1 and comprising: a main fixed plate 21, a moving plate 22, a small fixed plate 23 extending the moving plate 22, and an adjustable abutment 20.

The moving plates 5 and 22 are integral parts of a moving or assembly 30 which is stationary when the folding machine is in operation.

The folding machine operates as follows:

A document to be folded is inserted between rollers 26 and 27 along a path shown by arrow 29. Under the action of roller 26, the document advances into the top pocket constituted by plates 3 and 5 until the end of the document comes up against abutment 4. Rotation of the rollers 26 and 27 continues to advance the document and the document forms a buckle projecting from the orifice of the top pocket. The buckle is engaged and nipped between rollers 26 and 25 which thereby make a first fold in the document and then eject it into the bottom pocket constituted by plates 21 to 23.

Under the action of roller 26, the document advances into the bottom pocket until the end of the document that is constituted by its first fold comes up against abutment 20. The advance communicated by rollers 25 and 26 causes a buckle to be formed, which buckle projects from the orifice of the bottom pocket. The buckle is engaged and nipped between roller 24 and roller 26 which thereby make a second fold in the document and eject it along a path shown by arrow 28. The abutments 4 and 20 are adjustable in translation along their respective pockets so that the positions of the first and second folds along the document may be selected.

Figure 2:
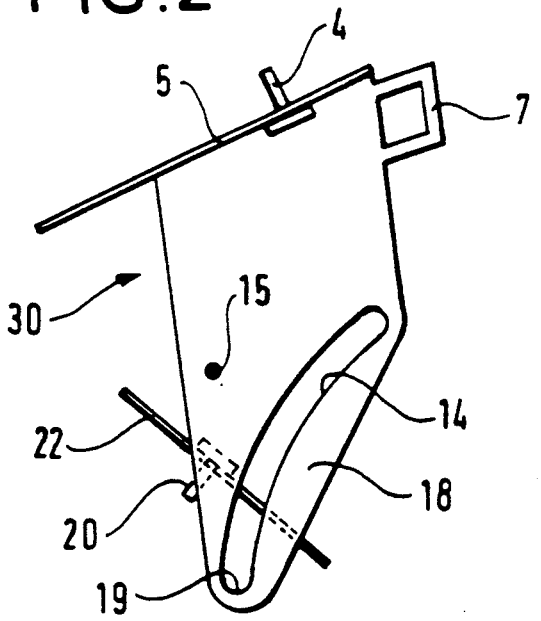
FIG. 2 is a diagram showing the moving portion of the embodiment.

FIG. 2 shows the moving assembly 30 independently from the rest of the mechanism of the folding machine for reasons of clarity. The moving assembly comprises:

the top pocket moving plate 5 complete with its adjustable abutment 4;

the bottom pocket moving plate 22 complete with its adjustable abutment 20; and two moving panels 18 which are substantially plane and perpendicular to the planes of plates 5 and 22 forming part of moving assembly 30.

Only one panel is shown in FIG. 2. The two panels are analogous in shape. Plates 5 and 22 form a fixed angle between each other which is about 70° in this embodiment and they are each fixed to the both panels 18. This angle is equal to the angle formed between the fixed plates 3 and 21 when the three portions of the machine are closed, so that the moving plates 5 and 20 are parallel to fixed plates 3 and 21 respectively.

Each panel of the moving assembly 30 includes a slideway 14 constituted by an oblong slot. Its outline is closed and comprises: two parallel edges in the form of arcs of concentric circles, and two semicircular ends. One of these ends 19 is used as an abutment during opening. Each panel further includes both a fixing point 15 for a spring, and also a lug 7 the purpose of which is described below. The lug 7 is plane in overall shape and has a rectangular opening.

FIG. 1 shows that the slideway 14 co-operates with two cylindrical guide pins 13 and 16 fixed to the bottom case portion 1. The diameter of each of the pins 13 and 16 is equal to the distance between the two edges of the slot constituting the slideway 14. Each slideway 14 and its guide pins 13 and 16 confine the moving assembly to a trajectory. Each panel is urged towards the top case portion 2 by a respective helical coil spring. Only one of these springs (referenced 9) is shown in FIG. 1. The spring 9 is fixed both to the point 15 of the panel 18 and to a fixing point 8 situated on the top portion 2.

An abutment 6 is constituted by a cylindrical pin which is fixed to the top case portion 1 and which projects into and is free to move inside the opening in the lug 7. When the two case portions 1, 2, and moving assembly 30 are closed, the spring 9 is extended and it presses the panel 18 against the abutment 6, the point of contact being one of the points on the edge of the opening in the lug 7. Since the panel 18 is guided by the pins 13 and 16 along a trajectory which is predetermined by the shape of the slideway 14, the abutment 6 determines a first end position of the moving assembly 30, which position corresponds to both pockets being closed. This end position determines both the gap between the plates 3 and 5, and the gap between the plates 21 and 22.

In the event of jamming, the motor driving the roller 26 is stopped and the user opens the two cases portions 1, 2, and moving assembly 30 so as to gain access to the path followed by the documents, and in particular to the insides of both pockets. While the top case portion 2 is being displaced relative to the bottom case portion 1, the moving assembly 30 continues to bear against the abutment 6 moving with the top case portion under continuing thrust from the spring 9. The abutment 6 slides along the edge of the opening in the lug 7. The moving assembly 30, held by the abutment 6, follows the trajectory which is predetermined by the shape of the slideway 14. In this embodiment, the trajectory is in the shape of an arc of a circle centered on a point 17. This point is situated outside the frame of the folding machine. Thus, the trajectory has low curvature and the displacement of the moving assembly 30 substantially resembles translation. The plate 22 is almost parallel to the plate 21 when the bottom pocket is open, thereby facilitating access to the bottom of the pocket.

In this embodiment, the rotary movement of the top case portion 2 about the hinge 10 is reduced by a transmission system constituted by the abutment 6 and the spring 9, so as to rotate the moving assembly 30 about the point 17 through a smaller angle of rotation. In this way, the bottom pocket opens without the top pocket tending to close. On the contrary, the top pocket opens. In order to reduce the movement of the top case portion 2, the abutment 6 is situated at a distance from the hinge 10 that is less than the distance between the abutment 6 and the point 17, regardless of the degree of opening.

During opening, the spring 9 relaxes and the moving assembly 30 is displaced to a position which is further away from the bottom portion 1. Simultaneously, the top case portion 2 also moves away from the bottom case portion 1, but it moves away faster than the moving assembly 30, so that the relative displacement of the top case portion 2 and the moving assembly 30 widens the gap between the fixed plate 3 and the moving plate 5 of the top pocket.

Figure 3:
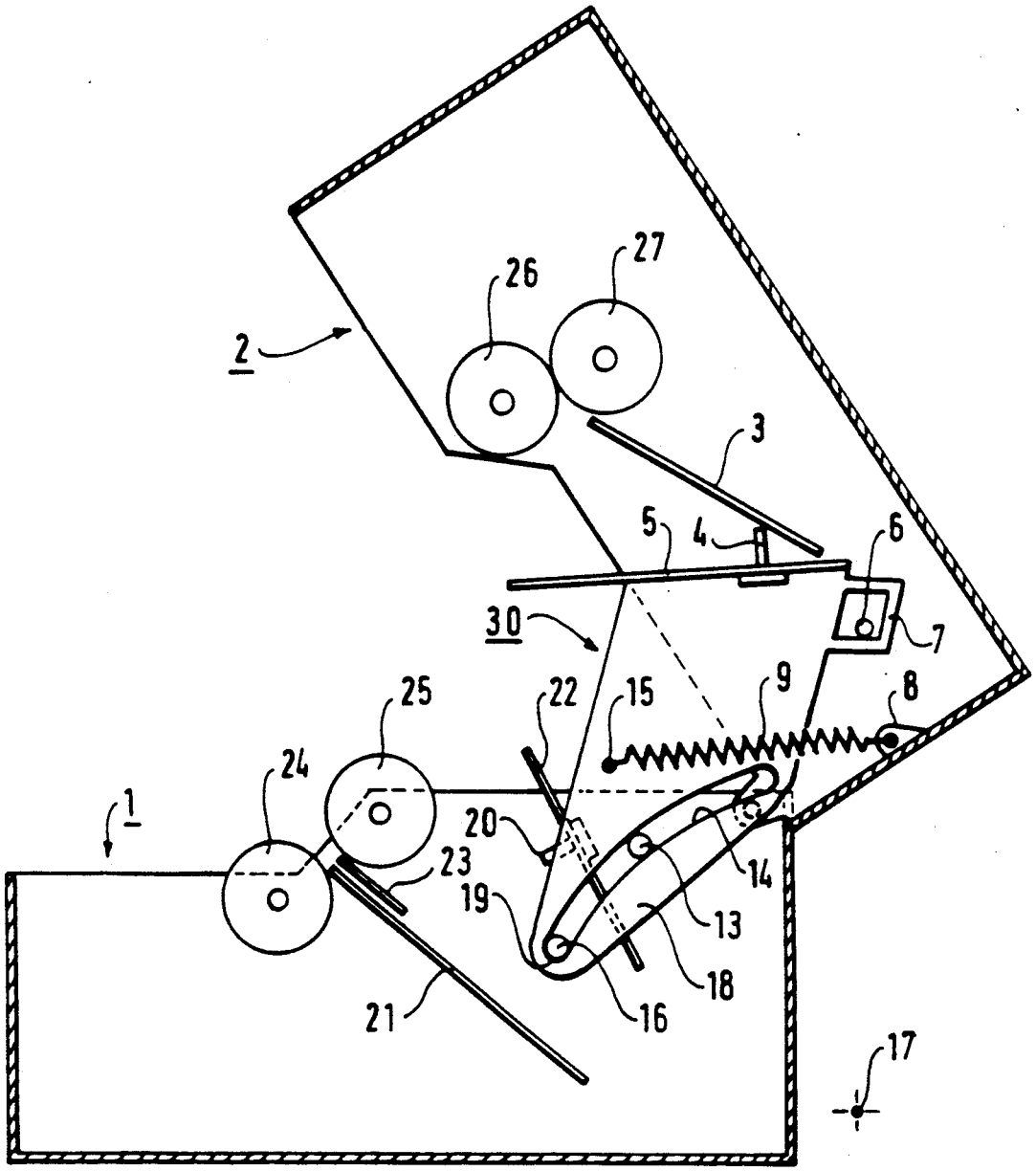
FIG. 3 is a diagram showing the embodiment with its three portions being open so as to allow access to the document path and, in particular, to the insides of the two pockets.

FIG. 3 shows this embodiment fully open. The spring 9 is then almost completely relaxed. However, it is still sufficiently tense to urge the moving assembly 30 against an abutment defining a second end position on the trajectory of the moving assembly. This end position is defined by the closed end 19 of the slideway 14 that bears against the guide pin 16. When this abutment 19 is reached, the abutment 6 no longer bears against the panel 18. At the end of the opening movement, the top case portion 2 is in a position which is defined by an abutment which is not shown. The top case portion is pressed against this abutment by an actuator including a spring. The position of the top case portion 2 is then such that the abutment 6 moves freely within the slot in the lug 7. The position of the moving assembly 30, which position is defined by abutment 19 and by the position of pin 16, is such that there is a wide gap between moving plate 22 and plate 21, even at the end opposite the end from which the paper is inserted, and such that there is also a wide gap between plates 3 and 5. It is further apparent that moving plate 22 is well clear of the nearest roller 25, so as to enable a user to insert a hand into the bottom of the bottom pocket.

It is possible for a user to widen the gap between moving plate 5 and fixed plate 3 even further by pulling plate 5, thereby stretching the spring 9 and moving the moving assembly 30 a little further away from the top case portion 1. This possibility is deliberately limited by means of the lug 7 which surrounds the abutment 6 and which bears thereagainst if the user exerts too great a force on plate 5.

It should be noted that if the point 17 is situated at infinity, the trajectory of the moving assembly 30 is then pure translation. The moving assembly 30 could be confined to a trajectory which is more complex in shape, e.g. an S-shaped trajectory, so as to optimize the gaps between the moving plates and the fixed plates in each of the pockets, when in the open position, and so as to optimize the displacement of the moving assembly 30 relative to the obstacles constituted by other components of the mechanism, during opening. Therefore, the scope of the invention is not limited to the embodiment shown in the figures and described above. A person skilled in the art can determine a trajectory different from a circular trajectory, given the position each moving plate is to occupy in the closed position, the desired position for each moving plate in the open position, and the constraints imposed on the trajectory by the obstacles adjacent to the moving assembly. A person skilled in the art can also implement other means of transmitting motion so as to reduce the rotation of the top portion case before transmitting motion to the moving assembly, e.g. by using connecting rods.

I claim:

1. A two-pocket folding machine, having a case, a top pocket and a bottom pocket, each pocket having a first plate and a second plate, and wherein said folding machine case comprises:

a top case portion which includes the first plate of the top pocket, said top pocket first plate being fixed to the top case portion;

a bottom case portion which includes the first plate of the bottom pocket, and to which is hinged the top case portion by a hinge, said bottom portion first plate being fixed to the bottom case portion;

a moving assembly including at least one movable panel, said second plate of the bottom pocket and the second plate of the top pocket, the two second plates being in fixed relationship with each other on said movable panel; and means carried by said top and bottom case portions for displacing the moving assembly along a predetermined trajectory with respect to the top and bottom case portions during opening and closing of the top and bottom case portions such that each of the second plates are parallel to and close to the corresponding first plates when said case portions are closed, and are moved away from each other when said case portions are open, so as to provide ready access to the insides of the pockets.

2. A folding machine according to claim 1, wherein the means for displacing the moving assembly comprise:

a slideway in said movable panel having a shape which confines the moving assembly to a predetermined trajectory relative to said bottom case portion; and transmission means for transmitting some motion from the top case portion to the moving assembly during case opening so that the fixed plate of the top pocket in the top portion moves further away from the bottom portion than does the moving plate of the top pocket, such that the relative displacement of the two plates of the top pocket moves them apart and provides access to the inside of the top pocket.

3. A folding machine according to claim 2, wherein the transmission means comprise:

at least one spring stretched between a point on the top case portion and a point on the at least one movable panel; and at least one abutment fixed to the top case portion, the movable panel bearing against said one abutment under the action of the spring, during opening and closing.

4. A folding machine according to claim 2, wherein overall shape of said slideway is an arc of a circle.

5. A folding machine according to claim 2, wherein the moving assembly at least one movable panel comprises two panels perpendicular to the two moving plates and fixed to said two moving plates, and each of the two panels including a slideway constituted by a slot cut through that panel.

6. A folding machine according to claim 5, wherein each movable panel of the moving assembly includes another slot defining a lug surrounding said abutment, thereby enabling a user to move the moving assembly additionally a little further away from the top case portion, while limiting the extent of this additional movement.

* * * * *